United States Patent [19]

Moulton

[11] Patent Number: 4,783,090

[45] Date of Patent: Nov. 8, 1988

[54] TRASH BAG HOLDER

[76] Inventor: Lee A. Moulton, 5081 Keane Dr., Carmichael, Calif. 95608

[21] Appl. No.: 69,501

[22] Filed: Jul. 2, 1987

[51] Int. Cl.[4] ..... B65D 67/12

[52] U.S. Cl. ..... 280/47.26; 248/98; 248/101

[58] Field of Search ..... 280/47.26, 47.24; 248/97, 98, 99, 101; 294/55

[56] References Cited

U.S. PATENT DOCUMENTS

| | | | |
|---|---|---|---|
| 3,188,109 | 6/1965 | Broadrick | 280/47.26 |
| 3,711,141 | 1/1973 | Soergel | 294/55 |
| 3,733,099 | 5/1973 | Szita | 294/55 |
| 3,754,785 | 8/1973 | Anderson | 294/55 |
| 3,942,832 | 3/1976 | Haas, Jr. | 294/55 |
| 4,023,842 | 5/1977 | Harvey | 294/55 |
| 4,202,521 | 5/1980 | Harding | 248/99 |
| 4,270,788 | 6/1981 | Overholt | 294/55 |
| 4,442,567 | 4/1984 | Pravettone | 248/99 |
| 4,457,549 | 7/1984 | Lowery | 294/55 |
| 4,620,319 | 10/1986 | Sheehan | 248/101 |

FOREIGN PATENT DOCUMENTS

| | | | |
|---|---|---|---|
| 174106 | 1/1961 | Sweden | 248/101 |
| 212688 | 3/1924 | United Kingdom | 248/99 |
| 1404302 | 8/1975 | United Kingdom | 248/101 |
| 1494835 | 12/1977 | United Kingdom | 248/101 |

*Primary Examiner*—David M. Mitchell
*Attorney, Agent, or Firm*—Leonard Bloom

[57] ABSTRACT

A trash bag holder having a hoop and rim frame assembly pivoted together to loop an edge of the trash bag thereabout, and the hoop has a feathered edge to facilitate debris throughpassage and to hold the rim. A support base is also provided.

19 Claims, 4 Drawing Sheets

FIG. 4
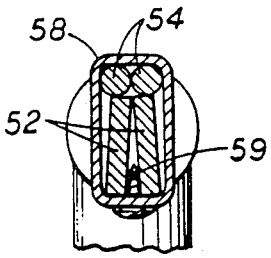
FIG. 3
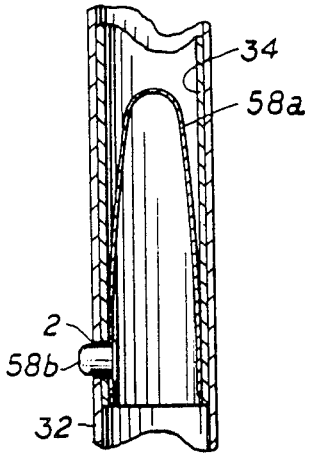
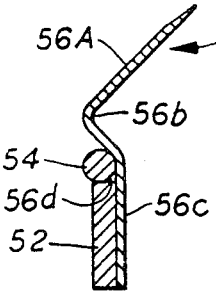
FIG. 5A
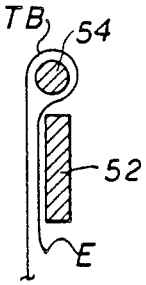
FIG. 5B
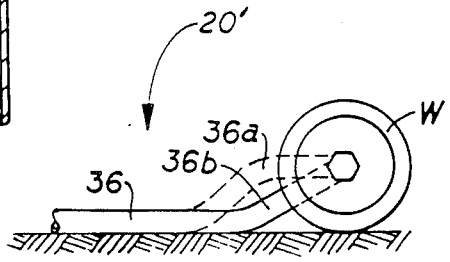
FIG. 6B
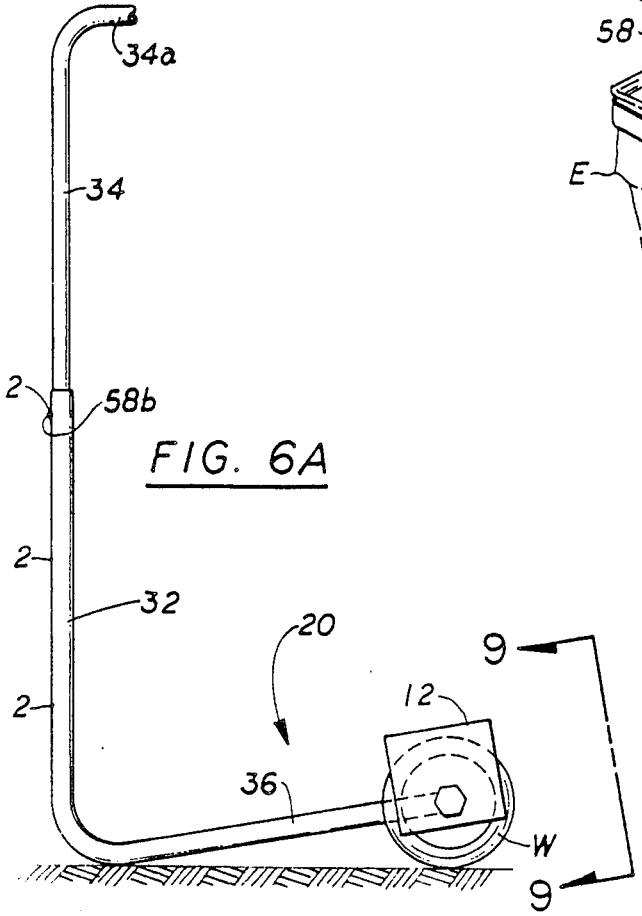
FIG. 6A
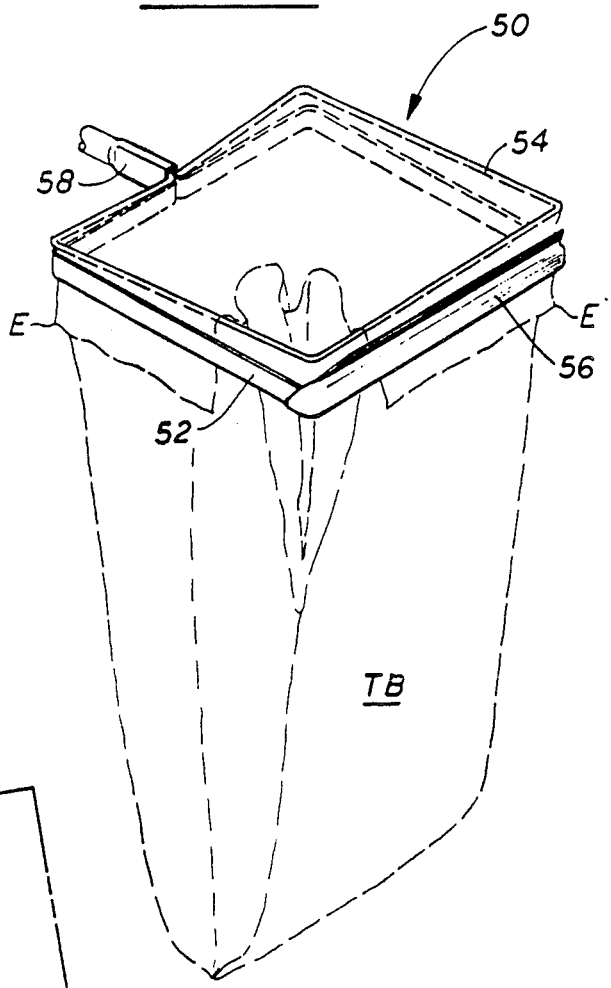
FIG. 7

TRASH BAG HOLDER

CROSS REFERENCE RELATED TO APPLICATION

This application represents an outgrowth of one aspect mentioned in Ser. No. 894,551, filed 08/08/86, entitled MULTIPLE USE ARTICLE CARRIER, now U.S. Pat. No. 4,759,559.

FIELD OF THE INVENTION

The following invention relates generally to frames used in supporting flexible trash bags. More particularly, the essence of the invention is to provide a frame which circumscribes and supports, an opening of a trash bag or the like in a reliable and secure manner. A further component comprising a stand is included which allows the trash bag opening frame to be free standing.

BACKGROUND OF THE INVENTION

A common problem exists with respect to flexible trash bags in maintaining the bag in an open position for subsequent filling. When the bag is used as a liner and conforms to the inner contour of a trash can, the opening, even if folded over the top edge of the supporting trash can, has a tendancy to collapse within the trash can. This is because the liner is influenced through friction and by entrainment with the debris which passes into the bag liner.

When the bag liner is used without the assistance of a supporting container, the problem is exacerbated because the bag has no memory which retains the open shape. Thus, an assistant is required to hold the bag in an open position or one of a person's hands is used in an attempt to open the bag to receive contents therewithin. Even with an assistant, the bag opening does not approach a cross sectional area which conveniently facilitates the through passage of material because the bag has not been constrained in its optimal widest open position.

The prior art is fairly rich in attempts to overcome the above stated deficiencies. Some of these patents have inherent dificulties in that they are somewhat dated. Thus, their structure cannot conform to the currently available bags now on the market. Mainly, these holders provide reusable bags that are custom contoured for the holder.

Other of these prior art devices include removeable clips or the equivalent which, while somewhat effective provides loose pieces which tend to get lost.

Another set of known prior art attempts includes a clamping type mechanism that is formed with the bag frame, and are therefore based on the same concept as the instant invention. These prior art attempts are deficient in at least one of the following areas: the ability to quickly fasten a removeable bag to an associated frame, the ability to securely fasten same, and the ability to secure the bag in such a manner that it does not interfere with the subsequent utilization of the thus supported bag.

SUMMARY OF THE INVENTION

The instant invention is distinguished over the known prior art in that the components that fix the bag to the associated frame are integrally formed as a single device thereby precluding the possibility of losing the fastening instrumentalities associated with the frame.

In addition, the device according to the instant invention expeditiously and securely fastens a bag to the associated frame without the associated problem of interfering with the inherent function to be performed by the bag.

Essentially, the device embraces a hoop formed from a strip of material such as metal, configured as a closed loop. The loop supports a complimentally formed rim of resilient material such as wire at one or two points along the periphery of the hoop. The rim has a memory or biased resilience to cause it to press against the frame and hold the bag therebetween. One edge of the hoop supports a lip having a feathered edge which is remote from a handle so that when the handle is grasped, the feathered edge can be placed on a surface and readily admit debris into the bag.

The rim and the hoop frame collectively grasp a trash bag which is first placed within both the hoop and the rim. The open edges defining the mouth of the bag are looped over the wire rim and underneath the rim inside the hoop so that a trash bag is securely attached. To further enhance the retention of the bag with respect to the frame, the rim is also captured by a recess on the feathered edge lip to firmly fix the rim with respect to the hoop and therefore the bag.

In another form of the invention, the hand held portion can be affixed to a free standing instrumentatility which includes at least one downwardly extending member which holds the hoop frame and rim in a horizontal position elevated above a support surface. The vertically downwardly extending support member attaches to a base configured for stability. The base may also include a supporting axle having wheels for ease in transport.

Another version contemplates providing a frame formed from a pair of vertically upstanding support members communicating the base to the hoop and rim frame.

When the hoop assembly includes a support stand, the trash bag captured by the hoop and the rim can be used as a free standing waste basket. Alternatively, the stand assembly can be tipped on its side so that the feathered edge contacts a support surface and debris can be swept within the bag since one's hands are free from holding the hoop handle.

OBJECTS OF THE INVENTION

Accordingly, it is a primary object of this invention to provide a novel and useful appliance to facilitate the use of trash bags.

A further object of this invention is to provide a device as characterized above which engages the mouth area of a conventional disposeable, flexible, trash bag in fixed relationship to a circumscribing frame so as to reliably enable use of the bag liner.

A further object of this invention contemplates providing a device as characterized above wherein a retaining rim is associated with a hoop collectively forming a frame which captures the bag securely for positive retention and support of the bag.

A further object of this invention contemplates providing a device as characterized above which can either be hand held or supported from a base to be free standing so as to provide a multiplicity of uses.

It is yet a further object of this invention to provide a device as characterized above wherein one edge of the hoop frame, remote from a hand holding area, includes a feathered edge to facilitate placement of the edge against a support surface to expedite passage of debris within to the trash bag.

It is yet a further object of this invention to provide a device as characterized above which is extremely durable in construction, safe to use, lends itself to economies of scale for mass production, is light weight and reliably secures a conventional garbage bag for the attendant purposes.

It is a further object to provide a device as characterized above which is so fabricated that when disassembled the elements are oriented in a substantially flat plane for convenient shipping.

These and other objects will be made manifest when considering the following detailed specification taken in conjunction with the appended drawing figures wherein there has been provided a means for removeably fastening a conventional trash bag mouth to a frame which retains the mouth, a handle on one side of the frame, a feathered edge on a remote side of the frame, and optionally, a support stand to hold the frame in an elevated horizontal position above the supporting surface.

BRIEF DESCRIPTION OF THE DRAWINGS FIGURES

FIG. 3 is a sectional view taken along lines 3—3 of FIG. 1.

FIG. 4 is a sectional view taken along lines 4—4 of FIG. 2.

FIG. 5A is a sectional view taken along lines 5A—5A of FIG. 2.

FIG. 5B is a sectional view taken along lines 5B—5B of FIG. 2.

FIG. 6A is a second embodiment showing the apparatus of FIG. 1 having a support base with wheels.

FIG. 6B shows an alternative with respect to a lower portion of FIG. 6A.

FIG. 7 shows the detail for the upper portion of FIG. 2.

BRIEF DESCRIPTION OF THE PREFERRED EMBODIMENT

Figure 1:
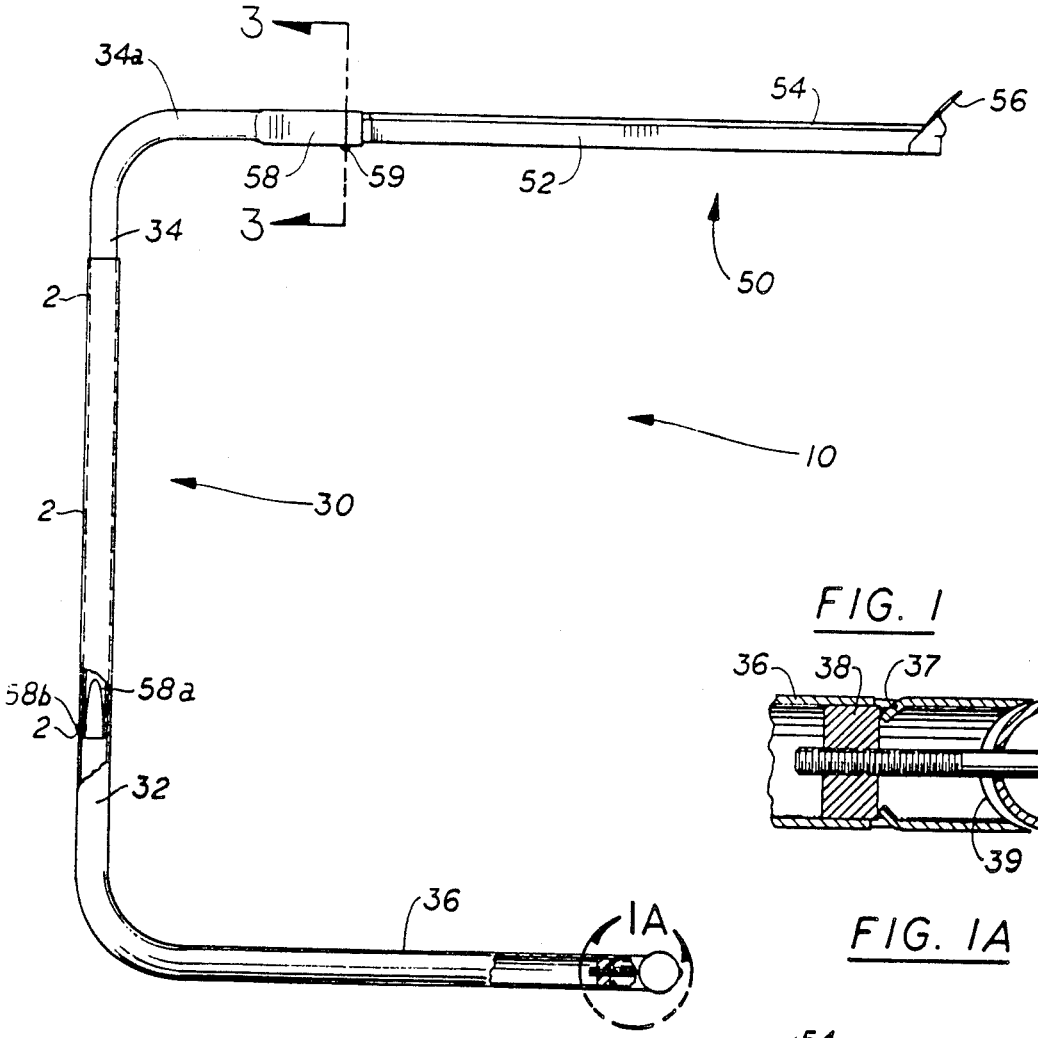
FIG. 1 is a side view of the apparatus according to the present invention in one form.

Referring to the drawings now, wherein like reference numerals refer to like parts throughout the various drawing figures, reference numeral 10 is directed to the trash bag holder according to the present invention.

In its essence, the trash bag holder 10 includes a hoop/rim type frame 50 or 60, which may be used independently or in combination with a stand assembly 20 or 20', 30 or 40. The hoop and frame assembly will first be discussed, particularly with reference to FIG. 5B.

As shown, a trash bag TB is fastened to the frame 50 by means of first taking the mouth opening of the trash bag and threading it within the interior of the frame. The peripheral edge E denoting the trash bag mouth is looped over a wire rim 54 and threaded between the wire rim 54 and a hoop 52. Contents within the bag provide a downward force pinching the rim 54 against the hoop 52 and in conjunction with other retention means, hold the bag in place securely.

More particularly, and with reference to FIGS. 1, 2, 7, 8 and 10 specific details with respect to the hoop and rim frame can now be explored. Basically, the hoop 52 is formed from a piece of material, preferrably metal, having rectangular cross section and formed so as to be a four sided hoop. Note a three sided, triangular version would also work acceptably. Ends of the hoop are placed in mating registry and fixed together by spot welding or riveting (not shown). The free ends of the hoop frame extend outwardly from a medial portion of an outside wall of one frame side and are received within a handle 58 (FIG. 3).

A side of the hoop frame 52 remote from the handle 58 supports a lip 56 along its length and about corners thereof. The lip 56 has a feathered edge **56*a* (FIG. 5A) which facilitates through passage of debris within the hoop. More particularly, the feathered edge 56*a*, forming a part of lip 56 includes an arcuate portion 56*b* which retains the wire rim 54. A linear portion 56*c* is attached to the hoop frame 52 so that the feathered edge 56*a* can be free standing. Note the presence of the notch 56*d* which serves as an abutment shoulder upon which the rim 54** resides.

The rim 54 is formed from a resilient material, preferrably wire, having a configuration complimental to that of the hoop 52 so that it overlies the hoop 52 as shown in FIG. 7. FIG. 3 details the means by which the wire rim 54 and hoop 52 attach to a sleeve 58 defining a handle. The free ends of both the hoop 52 and rim 54 terminate within the handle 58 and are retained therewithin by means of a screw 59 which passes between the free ends of the hoop 52 wedging them apart and against the sleeve 58. The rim 54 can optionally be track welded onto a top surface of the hoop 52 so that the remainder of the rim 54 is separable by biasing the rim 54 away from the hoop 52 to allow the trash bag TB to be placed as shown in FIG. 5B and FIG. 7. Once the trash bag TB has been placed as discussed, the edge of the rim 54 remote from the handle sleeve 58 is snapped into place by depressing the rim 54 into the lip 56.

Figure 8:
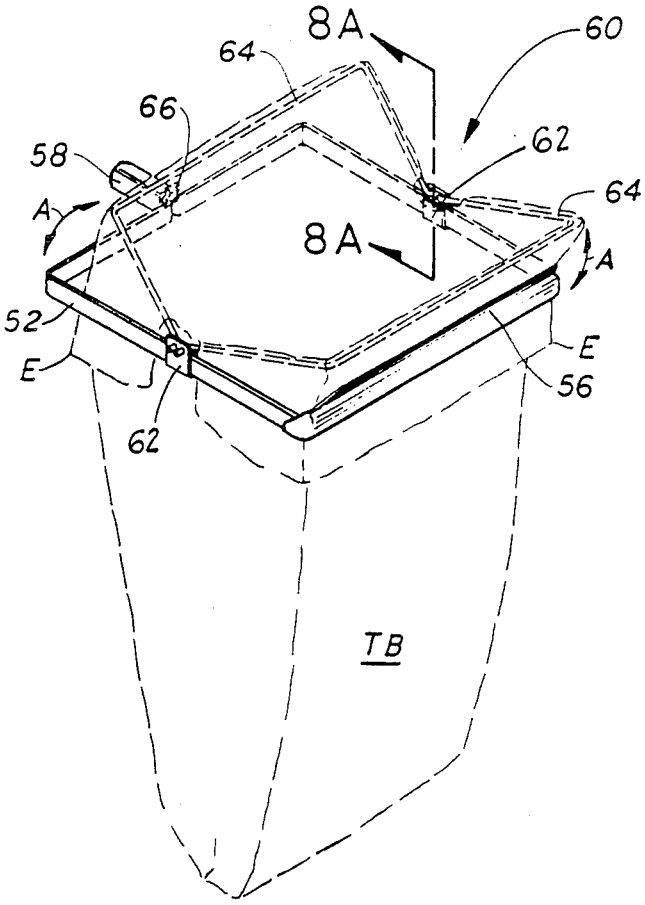
FIG. 8 shows a second embodiment for the upper portion of FIG. 2.

A different form of hoop rim frame arrangement is shown with respect to reference numeral 60 illustrated in FIG. 8. In this instance, the rim 64 is formed from two substantially U shaped pieces capable of articulation about sides of the frame 52. The rim 64 is not tack welded adjacent the handle 58, but is attached to the side edges of the hoop 52 substantially medially between the handle side 53 and the lip 56.

Figure 8A:
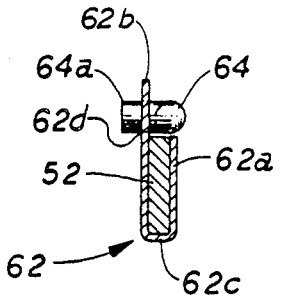
FIG. 8A is a detail of a retaining clip used with the embodiment shown in FIG. 8.

More particularly, a clip 62 (FIG. 8A) attaches the wire rim 64 in the following manner. A clip 62 having substantially U shaped configuration including a short leg **62*a*, a long leg 62*b* and a bight portion 62*c* straddles the frame hoop 52 from a bottom edge thereof and is frictionally retained thereon by means of the spring resilience of the clip 62. The long leg 62*b* extends upwardly and within the periphery of the hoop 52 and includes an opening 62*d* within which a free end 64*a* of the rim is rotatably placed. Thus, the two U shaped sections of rim 64 move in the direction of the arrows A and each rim segment is retained in a closed position either by the lip 56 or by a tang 66 adjacent the handle 58**.

Figure 10:
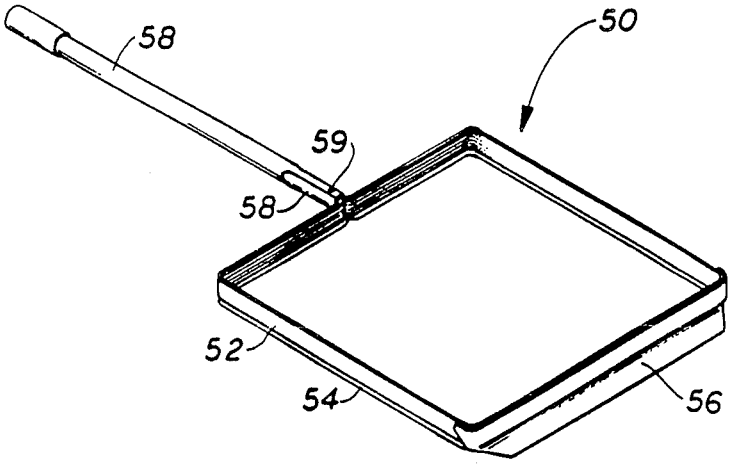
FIG. 10 is a bottom perspective view of that which is shown in FIG. 7, exemplifying an alternative straight elongate handle.

As shown in the various drawing figures, the handle 58 can be of various lengths or configurations. The handle 58 can have a terminal portion adjacent its connection to the hoop ends 52 and rim 54 that is rectangular in section (FIG. 10), paralleling the configuration of the hoop and rim portion that it overlies. Specifically, FIG. 10 shows an elongate handle arrangement which is squared adjacent the connection to the hoop 52 and rim 54. The handle is long enough so that the hoop and rim frame assembly reaches the ground easily and can be used independently of any other instrumentality other than the trash bag TB. In addition, however, the hoop/frame arrangement can be associated with a support stand so that the device can serve as a waste basket, for example, in a manner now to be defined.

Figure 2:
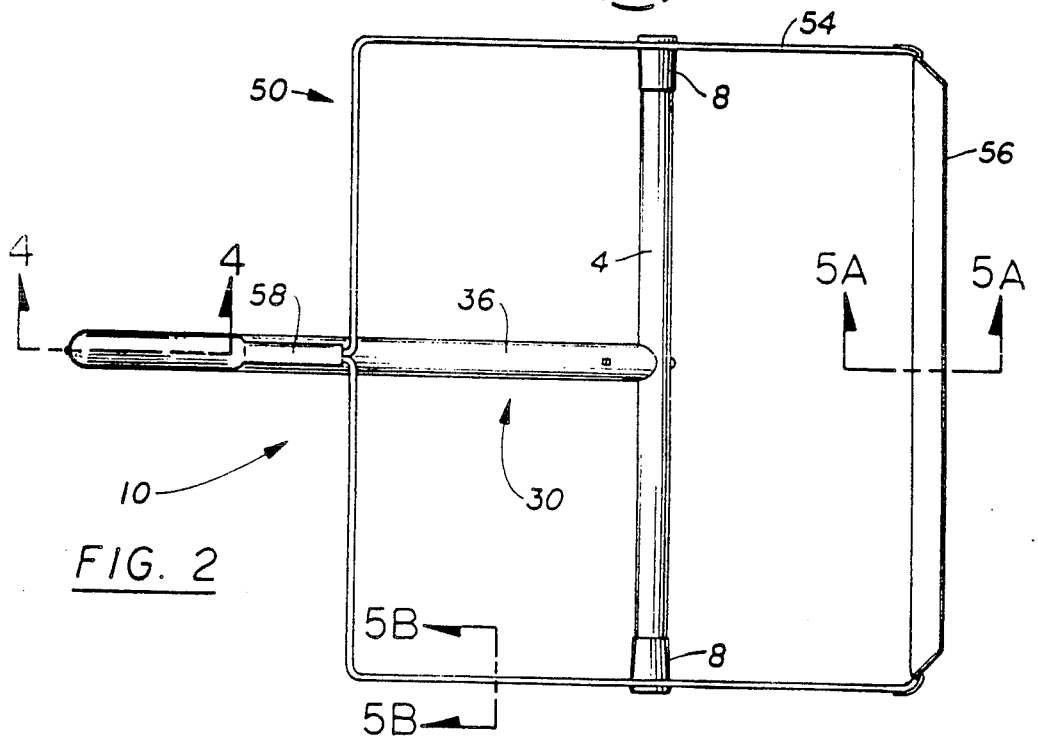
FIG. 2 is a top plan view from that which is shown in FIG. 1.

More particularly, and with reference to FIGS. 2 and 4 for example, the handle 58 can be integrally formed within a support member **34*a* defined simply as an upper horizontal portion of a vertical support member 34. The vertical support member 34 (FIG. 4) includes an internal spring 58*a* of "U" shaped configuration that supports a detent 58*b* passing through a hole 2 in a vertical sleeve 32. Thus, by depressing the detent 58*b* the member 34** can be raised or lowered changing the height of the hoop and frame assembly.

With respect to FIG. 1, a vertical support member 34, integral with the horizontal upper portion **34*a* telescopes within the sleeve 32 so the hoop and rim can be adjusted at different vertical elevations. By providing a plurality of holes 2 along the length of the sleeve 32 and providing the "U" shaped spring 58*a* within the support member 34**, the elevation of the hoop/rim arrangement can be alered so that different vertical elevations can be afforded the hoop while the hoop remains in a substantially horizontal plane.

Figure 1A:
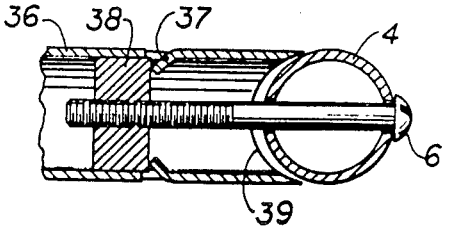
FIG. 1A is a sectional view of one detail in FIG. 1.

The lowermost end of the sleeve 32 terminates in a substantially horizontally extending base leg 36 which as shown in FIG. 2 extends below a central portion of the hoop to provide stability. The base leg 36 in turn communicates with a base transverse leg 4 disposed at right angles with respect to an end 39 of the base leg 36. The detail for this structure is shown at FIG. 1A. More particularly, the base leg 36 connects to the transverse leg 4 by means of a bolt 6 passing through a wall of the leg 4 and extending into the interior of the base leg 36. The bolt 6 is secured thereto by means of a nut 38 fixed on the interior of the base leg 36 by means of inwardly extending prongs 37 made by distressing the side wall portions of the base leg 36 inwardly to provide prongs 37 that retain the nut from translation outside of the base leg 36. As shown in FIG. 2, the transverse leg 4 has feet 8 at extremities thereof to prevent marring of the support surface.

Alternatively, and with respect to FIGS. 6A and 6B, the free end of the base leg 36 can lead to a transverse leg 4 that supports wheels W thereon. FIG. 6A shows that the base leg 36 is linear with respect to its extension to the transverse leg 4, but that the bend in the tubing between the sleeve 32 and the base leg 36 is less than 90 degrees to offset the incline in support 36 dependent on the size of wheels W. This angle can be varied as desired. In addition, FIG. 6B has two variations of free ends of the base leg 36 in which **36*a* shows a possible serpentine configuration with a free end substantially parallel to the major aspect to the base leg 36, or alternatively a free end 36*b*** which is upwardly angulated.

Figure 9:
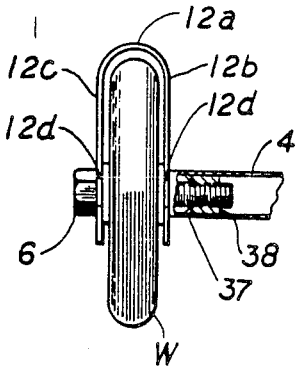
FIG. 9 is a detail for fastening the wheels shown in FIGS. 6A and 6B.

With respect to the wheels W, FIG. 9 shows a construction detail for the free ends of the transverse leg 4 as it supports the wheels W. As shown, a bolt 6 attaches the wheel W to a nut 38 fixed with the tubing of the transverse leg 4. The transverse leg 4 includes prongs 37 formed by distressing and bending in portions of the transverse leg 4. The wheel W itself is supported by means of a fender 12 of substantially "U" shaped configuration. Inboard fender leg **12*b*, an outboard fender leg 12*c* and a bight portion 12*a* collectively straddle the wheel W. Holes 12*d* are provided to allow the through passage of the bolt 6** therethrough.

Figure 11:
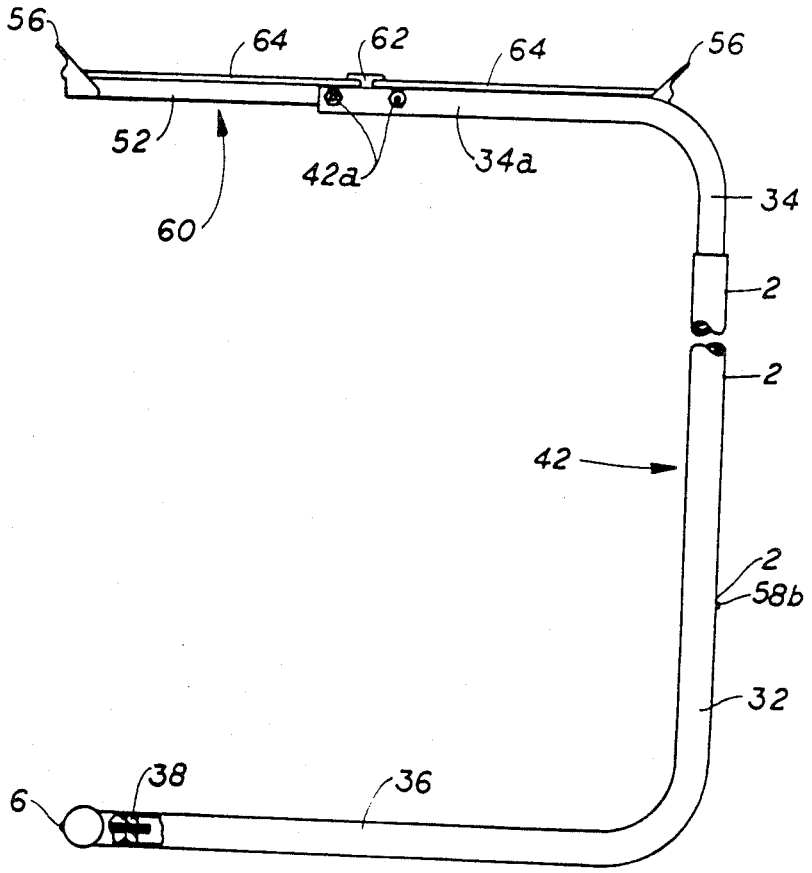
FIG. 11 is a side view of an alternative stand from that which is shown in FIG. 1 using the hoop frame of FIG. 8.
Figure 12:
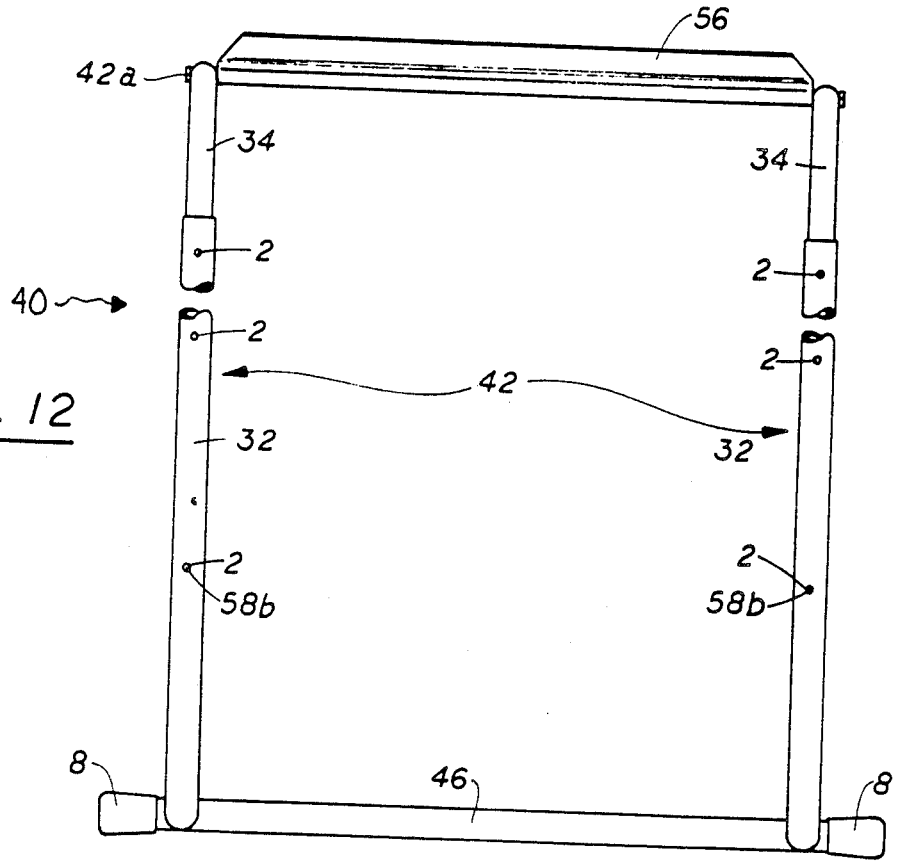
FIG. 12 is a front view of that which is shown in FIG. 11.

FIGS. 11 and 12 detail another possible embodiment 48 with respect to the support stand. As shown, this stand favors utilization with the hoop/rim version 60 including two rim sections 64. In this eventuality, a pair of vertical support members 42 extend downwardly from side edges of the hoop 52 proximate to where the clip 62 attaches the rim 64 to the hoop frame 62. A pair of nuts and bolts **42*a* attach the upper horizontal portion 34*a* to the frame 52 and the vertical support member 34 and sleeve 32 include a base leg 36 so that as shown FIG. 12, two substantially "L" shaped support members carry the hoop/frame in an elevated horizontal position. The base leg 36 include a leg 46 interconnecting the two "L" shaped support members at ends of legs 36** for stability.

Note that no component discussed above has substantial "thickness", three dimensionally. Thus, when disassembled, a kit is provided which can be shipped in a relatively thin container.

Having thus described the invention it should be apparent that the numerous structural modifications and adaptations may be resorted to without departing from the spirit of the invention set forth herein above and defined herein below in the claims.

I claim:

1. A holder for trash bags having a top portion including a mouth opening formed therein, the holder comprising:

a hoop having a peripheral dimension corresponding to the mouth of the trash bag, a rim fixed to at least one spot of said hoop and having a peripheral dimension identical to said hoop, the hoop further having a top edge upon which the rim is secured and abuts for securely retaining and holding the bag in place, a lip having a length extending along at least a portion of the peripheral dimension of the hoop and secured thereto outwardly of the rim, the lip having a feathered edge positioned on an external edge of said hoop remote from the depending trash bag, said lip including a notch along its length and facing inwardly towards said rim to receive and retain said rim therein, the trash bag is received within the peripheral dimension of both the hoop and the rim, the bag having the top portion thereof looped over the rim and downwardly exteriorly of the rim, said top portion further being threaded inwardly between the rim and the top edge of the hoop, such that filling of the trash bag forces the rim downwardly thereby pinching the rim against the top edge with the top portion of the bag therebetween for securely holding the bag in place.

2. The combination of claim 1 wherein said hoop includes a handle which extends from a side of said hoop remote from said feathered edge.

3. The combination of claim 2, further comprising:

a stand support base received and supported on a support surface;

a vertical support stand carried by the base; and means for removably securing said handle to the stand and supporting said hoop and rim carried by the handle in a substantially horizontal plane, vertically elevated from the support surface.

4. The combination of claim 3 including stand adjusting means for alternating the vertical elevation of said hoop and rim.

5. The combination of claim 4 including a stand support base formed from a base leg extending from a vertical support member defining said supporting stand, and a transverse base leg connected to said base leg.

6. The combination of claim 5 wherein free ends of said transverse base leg support wheels thereon.

7. A holder for trash bags having a mouth opening comprising:

a hoop having a peripheral dimension corresponding to the mouth of the trash bag, a rim fixed to at least one spot of said hoop and having a peripheral dimension identical to said hoop, and a lip having a length extending along at least a portion of the peripheral dimension of the hoop, said lip having a feathered edge positioned on an edge of said hoop remote from the depending trash bag, said lip including a notch along its length and facing said rim to receive and retain said rim therein, wherein said hoop includes a handle which extends from a side of said hoop remote from said feathered edge, and wherein said rim is formed from two "U" shaped sections, each attached to said hoop pivotally and at midpoints of said hoop between said feathered edge and said handle, and said handle includes a tang which catches one said "U" shaped rim section, while said feathered edge notch catches another "U" shaped rim section.

8. The combination of claim 7, further including a clip, said clip attaches said rim sections to said hoop and has a clip short leg, a long leg and a bight portion therebetween, thereby defining a substantially "U" shaped clip, said clip long leg placed on an inner periphery of said hoop and including a clip hole formed therethrough, through which a free end of said rim is pivotally attached.

9. The combination of claim 8, further comprising:

a stand support base received and supported on a support surface;

a vertical support stand carried by the base; and means for removably securing said handle to the stand and supporting said hoop and rim carried by the handle in a substantially horizontal plane, vertically elevated from the support surface.

10. The combination of claim 9, further including stand adjusting means for altering the vertical elevation of said hoop and rim.

11. The combination of claim 10, wherein the stand support base includes a base leg extending substantially horizontally from the vertical support stand, and a transverse base leg connected to said base leg.

12. The combination of claim 11, wherein the transverse base leg has a pair of opposite free ends, the free ends of said transverse base leg support wheels thereon.

13. The combination of claim 12 wherein said wheels attach to said transverse base leg by means of an inverted "U" shaped fender overlying said wheel and supported on said transverse base leg by a bolt passing through said fender and wheel and threaded to a nut fixed in said transverse base leg.

14. A holder for trash bags having a mouth opening comprising:

a hoop having a peripheral dimension corresponding to the mouth of the trash bag, a rim fixed to at least one spot of said hoop and having a peripheral dimension identical to said hoop, and a lip having a length extending along at least a portion of the peripheral dimension of the hoop, said lip having a feathered edge positioned on an edge of said hoop remote from the depending trash bag, said lip including a notch along its length and facing said rim to receive and retain said rim therein;

wherein said hoop includes a handle which extends from a side of said hoop remote from said feathered edge; and a stand support base received and supported on a support surface;

a vertical suport stand carried by the base; and means for removably securing said handle to the stand and supporting said hoop and rim carried by the handle in a substantially horizontal plane, vertically elevated from the support surface;

including stand adjusting means for altering the vertical elevation of said hoop and rim;

wherein the stand support base includes a base leg extending substantially horizontally from the vertical support stand, and a transverse base leg connected to said base leg, wherein the transverse base leg has a pair of opposite free ends, the free ends of said transverse base leg support wheels thereon; and wherein said wheels attach to said transverse base leg by means of an inverted "U" shaped fender overlying said wheel and supported on said transverse base leg by a bolt passing through said fender and wheel and threaded to a nut fixed in said transverse base leg.

15. The combination of claim 14 wherein said base leg is fixed to said transverse base leg via a bolt passing through said transverse base leg and captured by a nut fixed in said base leg.

16. The combination of claim 15 wherein said stand adjusting means includes a telescoping support member and a telescoping sleeve extending therefrom adjustible by a "U" shaped spring carried by said sleeve having a detent passing through one of several holes on said support member to fix said support member with respect to said sleeve.

17. A holder for trash bags having a mouth opening comprising:

a hoop having a peripheral dimension corresponding to the mouth of the trash bag, a rim fixed to at least one spot of said hoop and having a peripheral dimension identical to said hoop, a lip having a length extending along at least a portion of the peripheral dimension of the hoop, said lip having a feathered edge positioned on an edge of said hoop remote from the depending trash bag, said lip including a notch along its length and facing said rim to receive and retain the rim therein, a support stand secured to a side of said hoop remote from said feathered edge, wherein said rim is formed from two "U" shaped sections, each attached to said hoop pivotally and at midpoints of said hoop between said feathered edge and said handle, said support stand including a tang which catches one said "U" shaped rim section, while said feathered edge notch catches another "U" shaped rim section, wherein a clip attaches said rim sections to said hoop defined by a clip short leg, a long leg and a bight portion therebetween, thereby defining a substantially "U" shaped clip, said clip long leg placed on an inner periphery of said hoop and including a clip hole through which a free end of said rim is pivotally attached, a support stand formed from a pair of "U" shaped legs having a transverse base leg carry said hoop and rim sections adjacent said clips.

18. The combination of claim 17 wherein said pair of "U" shaped legs have free ends, one end attached to said base leg and another end to said hoop to support same.

19. A kit for holding a trash bag having a top portion including an opening formed therein, said kit comprised of:

a frame for the bag including a hoop and a complementally formed rim pivoted to the hoop, the hoop further having a top edge upon which the rim is secured and abuts for securely retaining and holding the bag in place, a handle and a feathered edge on opposed sides of the hoop, said feathered edge positioned on an external edge of said hoop, a notch formed on the feathered edge facing inwardly towards said rim to receive and retain the rim thereto, a support stand removably attached to the handle and adjustable in height, a support base connected to the stand, stabilizing the stand, whereby said kit when disassembled forms a flat thin package for easy shipping, and further whereby when assembled, the trash bag is received within the hoop and the rim, the bag having the top portion thereof looped over the rim and downwardly exteriorly of the rim, said top portion further being threaded inwardly between the rim and the top edge of the hoop, such that filling of the trash bag forces the rim downwardly thereby pinching the rim against the top edge with the top portion of the bag therebetween for securely holding the bag in place.

* * * * *